US005415241A

United States Patent [19]

Ruffu et al.

[11] Patent Number: 5,415,241

[45] Date of Patent: May 16, 1995

[54] EXPLOSIVE ACTUATED BATTERING RAM

[75] Inventors: Michael S. Ruffu; Paul J. Shemeta, both of Seattle, Wash.

[73] Assignee: TAC Inc., Seattle, Wash.

[21] Appl. No.: 111,464

[22] Filed: Aug. 25, 1993

[51] Int. Cl.[6] ..... B25D 9/11

[52] U.S. Cl. ..... 173/212

[58] Field of Search ..... 173/210, 211, 212, 90, 173/91; 30/367, 362; 29/254

[56] References Cited

U.S. PATENT DOCUMENTS

| | | | |
|---|---|---|---|
| 3,246,396 | 4/1966 | Temple et al. | 30/367 |
| 3,469,504 | 9/1969 | Neighorn | 173/212 |
| 3,610,504 | 10/1971 | Oesterle | 227/8 |
| 3,792,739 | 2/1974 | Deike | 173/118 |
| 4,131,165 | 12/1978 | Wanner et al. | 173/211 |
| 4,366,868 | 1/1983 | Salmi | 173/105 |
| 4,470,440 | 9/1984 | Thor | 144/193 |
| 4,658,629 | 4/1987 | Milisavljevic | 72/453.02 |
| 4,681,171 | 7/1987 | Kee et al. | 173/90 |
| 4,850,437 | 7/1989 | Sudnishnikov et al. | 173/13 |
| 5,088,174 | 2/1992 | Hull et al. | 29/254 |
| 5,167,043 | 12/1992 | Lopez et al. | 7/144 |
| 5,177,850 | 1/1993 | Hull et al. | 29/254 |

*Primary Examiner*—Hwei Siu Payer

*Attorney, Agent, or Firm*—Christensen, O'Connor, Johnson & Kindness

[57] ABSTRACT

A battering ram device is provided for allowing quick forcible entry through locked closures. The device includes a ram that slides within and partially out of a housing. The ram is connected to a piston which also slides within a cylindrical housing. The housing is connected to a firing mechanism that uses an explosive cartridge for driving the piston forwardly and subsequently forcing the ram partially out of its housing to deliver a blow to a closure. The piston and cylinder further include an energy absorbing mechanism for retarding the motion of the ram once it penetrates through a closure. The ram can be configured as a thin rectangular piece for allowing the ram to fit between a door knob and jamb of most doors. Other ram configurations include a punch for effectively knocking out a door lock of a steel or metal door, and a shearing head for effectively cutting a steel cable, bar, or wire.

20 Claims, 8 Drawing Sheets

EXPLOSIVE ACTUATED BATTERING RAM

BACKGROUND OF THE INVENTION

The present invention relates to a battering ram device for allowing quick forcible entry into rooms and buildings having doorways, windows or other types of closures. Such devices are commonly used by law enforcement officials to forcibly enter closures that are locked. The devices are also used by firemen who find various closures that are locked during a fire.

The most common form of battering ram is a manually actuated ram of considerable weight which often requires more than one person to swing the ram against the closure. There are many disadvantages with the use of these manually operable rams. First, the effectiveness of the ram is dependent upon the strength of the user(s). Second, a manually actuated ram is very heavy and bulky which makes it difficult to handle and requires a large amount of materials to manufacture. Third, there is no shock or energy absorbing mechanism within a manual ram. Fourth, there is a relatively low upper limit to the amount of force that a manual ram can deliver to a closure. Fifth, once the manual ram penetrates and breaks through a closure there is no mechanism to stop or slow the ram from continuing onwardly and causing considerable unintended damage to anything located beyond the closure. And, sixth, many hits are needed to break through a door which allows time for a potential criminal to escape or dispose of evidence, or allows time for a fire to grow in size. Generally, manual battering rams have fallen considerably short of an ideal instrument for allowing forcible entry through a closure.

Other types of impact devices are used for applications that are quite different from forcible entry through a closure. For example, jack hammers use a pneumatic or hydraulic actuated piston for driving a hammer vertically into the ground. These devices generally are suited for vertical operation, only. The devices use bulky air compressors, and do not include any energy absorbing mechanism. Furthermore, such devices, if used in a forcible entry application, generally cannot deliver a high enough energy per blow to meet most forcible entry applications.

Another prior art impact device uses an explosive cartridge to drive a nail, bolt, or screw. This type of device is specially designed for this specific application, and therefore, does not include any energy absorbing mechanism, and is set to deliver the exact amount of energy to drive a fastener into a specific material without breaking the fastener. Generally, impact driving tools such as bolt driving guns and jack hammers are set for specific applications, such as driving a nail into wood or driving a hammer into pavement. These applications need not consider an energy absorbing device for preventing the impact piece from driving too far.

The aforementioned prior art devices fail to provide an effective battering ram that can meet almost all forcible entry type applications.

SUMMARY OF THE INVENTION

It is an object of this invention to provide a battering ram that is not dependent upon the operator's strength and has a relatively high energy per blow.

Another object of the invention is to provide a ram that has an effective energy absorbing mechanism to prevent the ram from extending too far.

It is a further object of the invention to provide a ram that is easy to handle, easy to use, and uses a minimum of material in its manufacture.

Other objects of the invention will be apparent hereinafter from the specification and from the recital of the appended claims, particularly when read in conjunction with the accompanying drawings.

The present invention comprises an explosive actuated battering ram. The device includes a ram that slides within and partially out of a housing. The ram is connected to a piston which also slides within a cylindrical housing. The housing is connected to a firing mechanism that uses an explosive cartridge for driving the piston forwardly and subsequently forcing the ram partially out of its housing to deliver a blow to a closure. The piston and cylinder further include an energy absorbing mechanism for retarding the motion of the ram once it penetrates through a closure. The ram can be configured as a thin rectangular piece for allowing the ram to fit between a door knob and jamb of most doors. Other ram configurations include a punch for effectively knocking out a door lock of a steel or metal door, and a shearing head for effectively cutting a steel cable, bar, or wire.

DETAILED DESCRIPTION OF THE INVENTION

Figure 1:
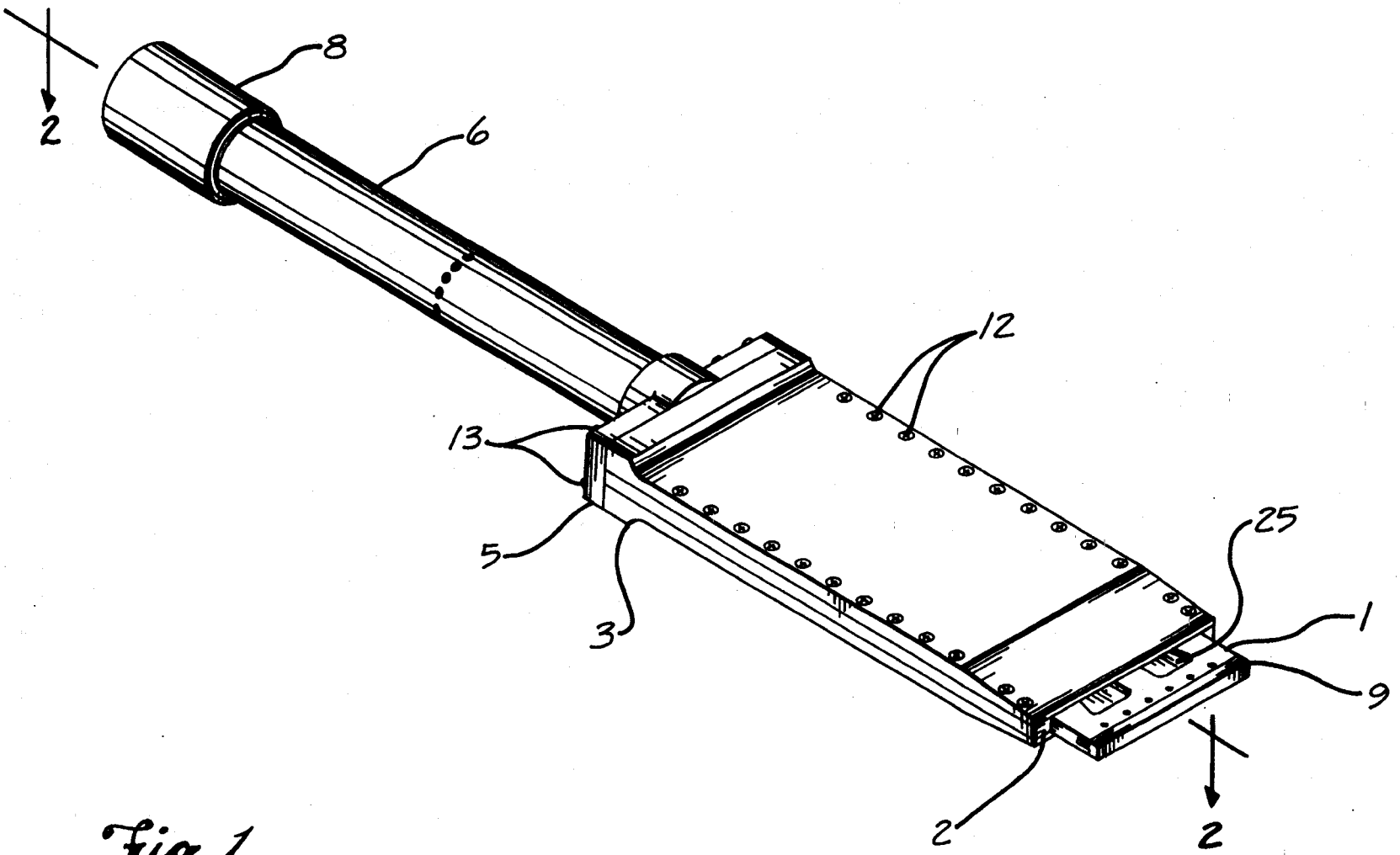
FIG. 1 shows a perspective view of the battering ram of the present invention.

FIG. 1 shows the preferred embodiment of the battering ram of the present invention. The battering ram includes a ram 1 that is guided for reciprocal motion within a housing that comprises a pair of side plates 3 connected to a pair of guide rails 2 and an end mounting plate 5. The side plates 3 are secured to the guide rails 2 by a series of screw 12. Each screw extends through a countersunk bore at the edge of the top side plate, a bore through the guide rail and a threaded bore through the edge of the bottom side plate. A cylindrical tube 6 is attached to the mounting plate end of the ram housing by threads. At the opposite end of the tube is a second thread that attaches a firing chamber 8 to the battery ram. A ramming edge 9 is formed at the end of the ram 1 and provides the ramming surface to allow forced entry through a door, as will be explained below.

Figure 2:
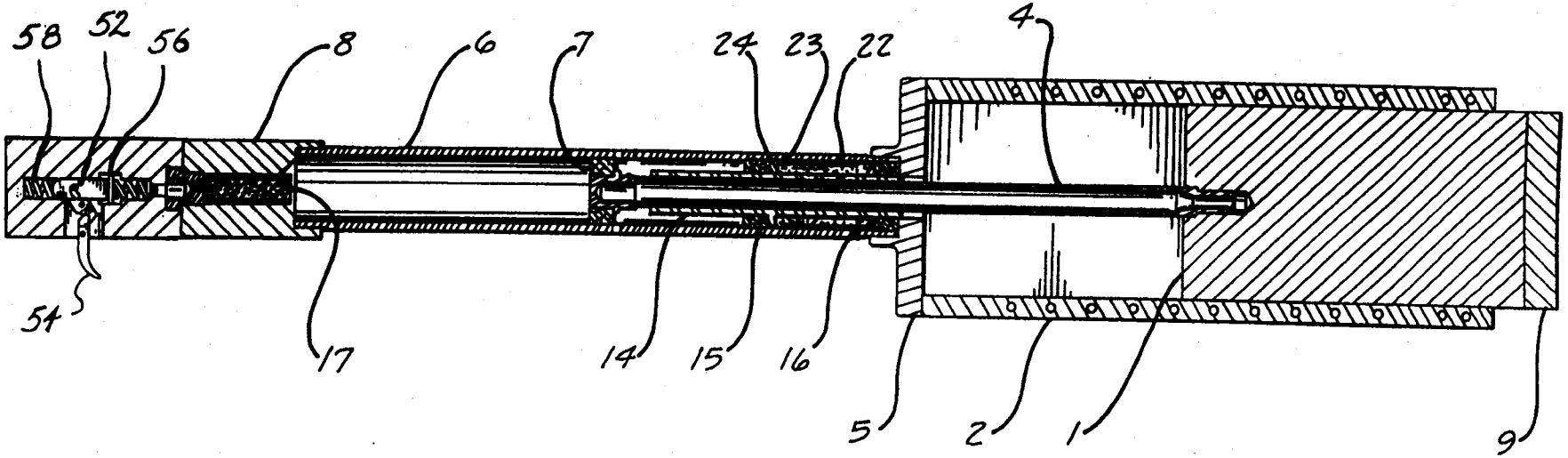
FIG. 2 shows a cross sectional view of the battering ram of FIG. 1 along lines 2—2.

Inner details of the battering ram can be viewed within FIG. 2. In normal use, the ram will slide horizontally with the relatively wide dimension of the ram 1 arranged vertically adjacent the door to be forced open.

Such a horizontally disposed position is depicted in FIG. 2 where the ram 1 is guided for reciprocal sliding motion between the guide rails 2. Although this would be the most common orientation in use, the battery ram could also be oriented in a number of different ways at various angles to horizontal. The ram housing formed by the guide rails 2, side plates 3, and end mounting plates 5 is oiled to allow a smooth reciprocal motion of the ram 1 within the housing. The end mounting plate 5 is attached to the pair of side plates 3 by threaded bolts 13. In this case, four bolts firmly secure each side plate to the end mounting plate. A central hole 21 exists within the end mounting plate to allow the rod 4 of the ram and a portion of the shock absorber 14 to slide through the ram housing, as will be explained later in the specification.

The piston/cylinder assembly includes the outer cylindrical tube 6 which forms a hollow cylindrical housing for the piston 7, rod 4, and shock absorber 14. The chamber 8 has internal threads to mate with external threads formed on the end of the tube 6. At its opposite end the tube has threads that attach to the end mounting plate 5 of the ram housing.

Figure 3:
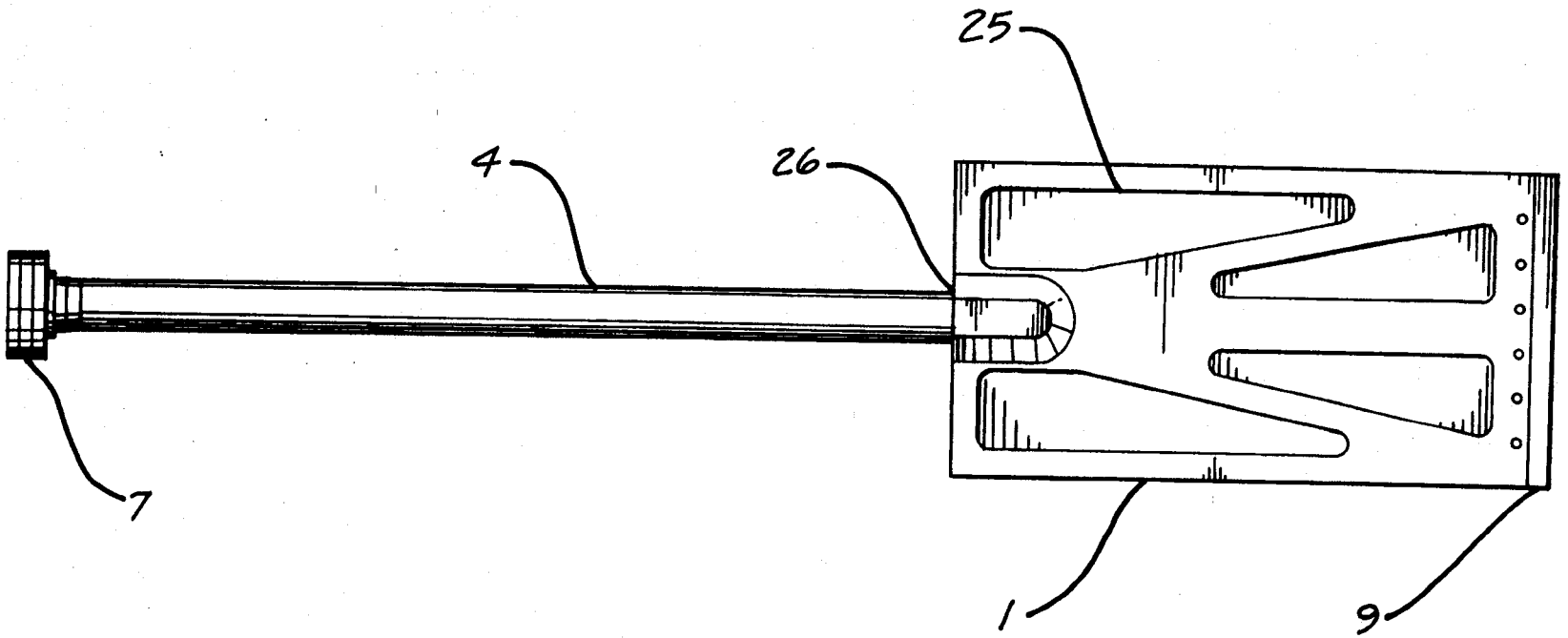
FIG. 3 shows a side plan view of the piston, rod and ram of FIG. 1.
Figure 7:
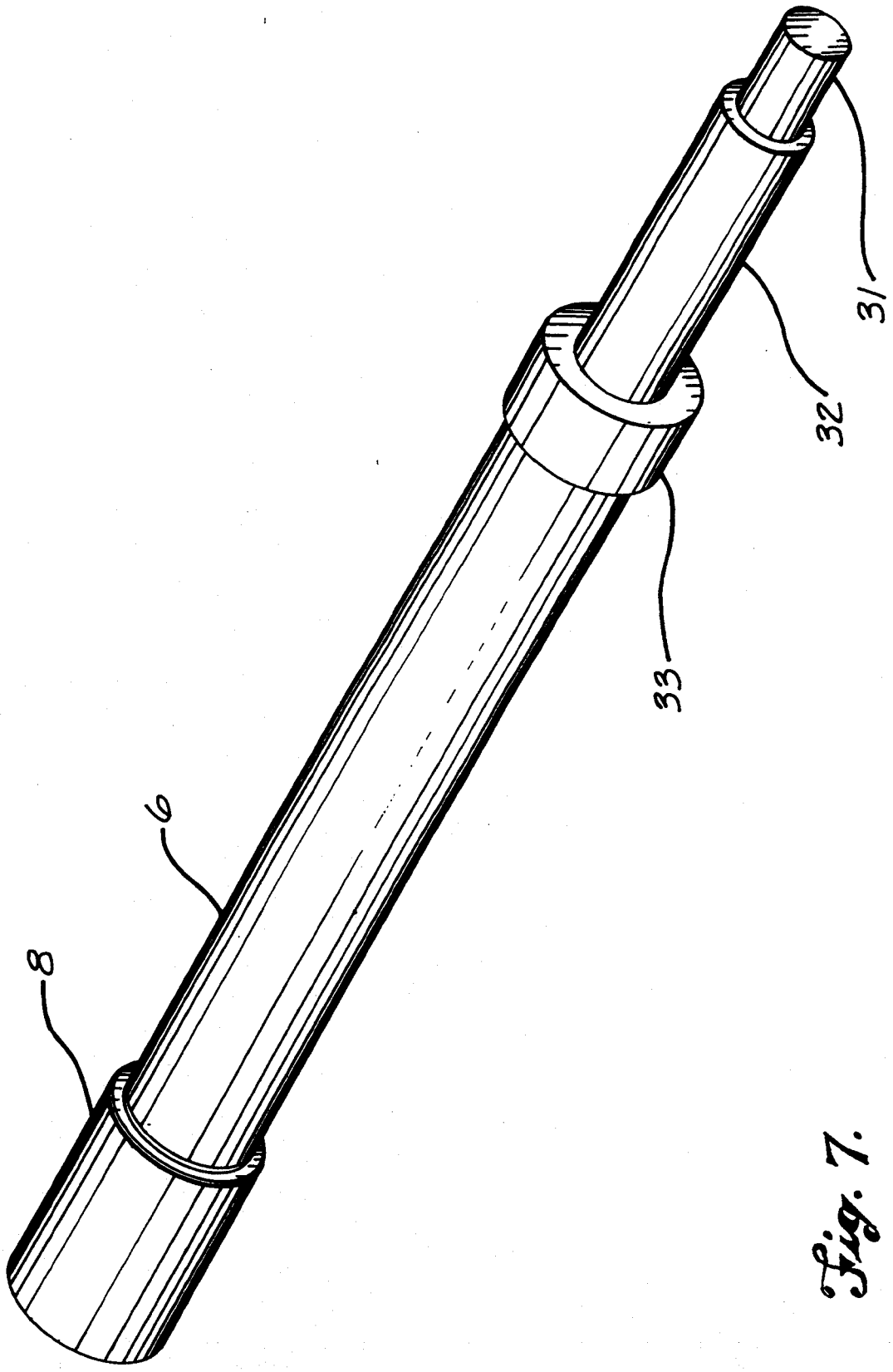
FIG. 7 shows a first attachment for the battering ram of FIG. 1.
Figure 8:
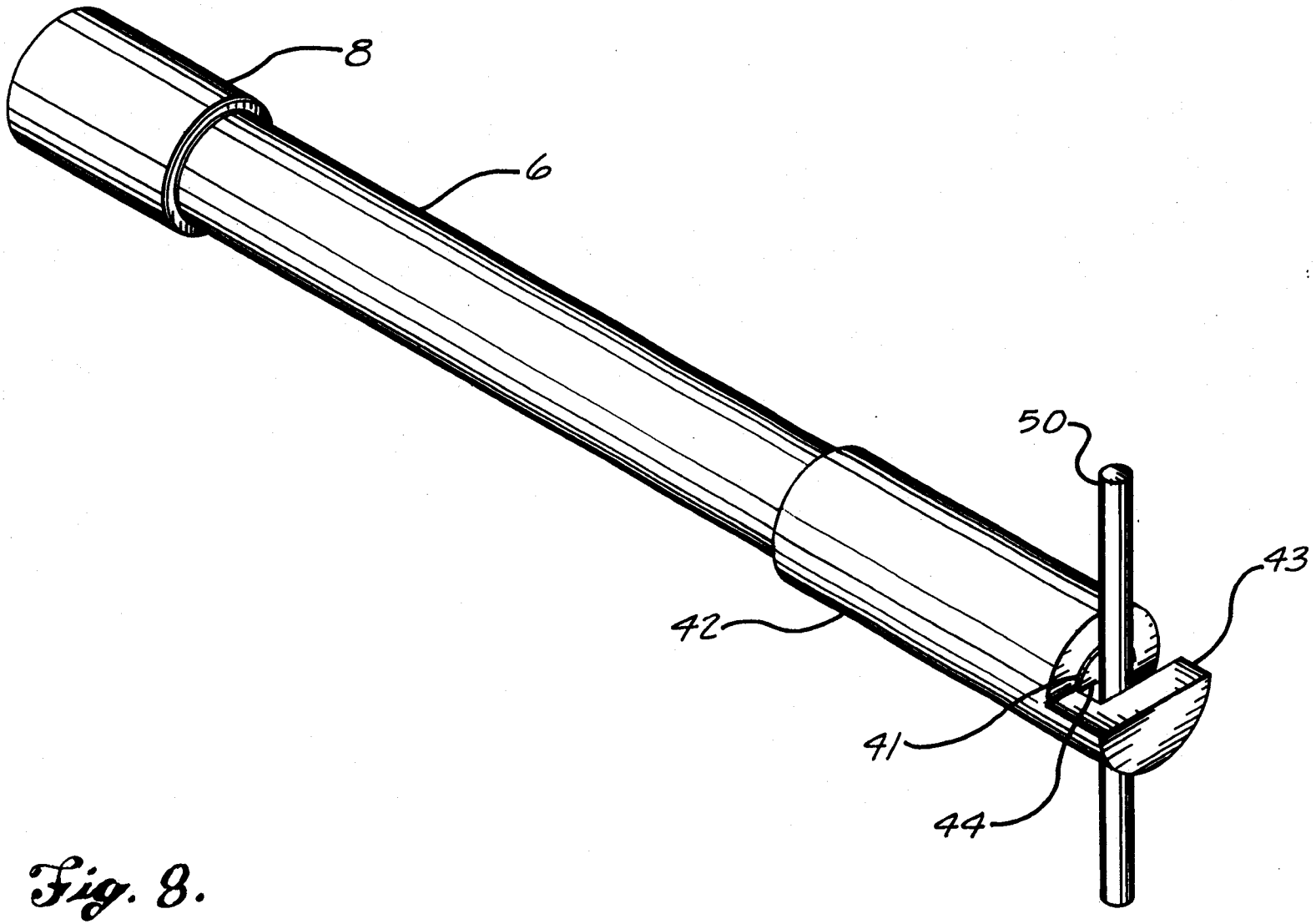
FIG. 8 shows a second attachment for the battering ram of FIG. 1.

Details of the piston, rod, and ram piece may be seen in FIGS. 2 and 3. The piston 7 has a diameter that is slightly smaller than the inner diameter of the tube 6 so that the piston may freely slide within the tube. The rod 4 is rigidly connected at one end to the piston and at the opposite end to the ram 1 forming a single rigid piece. It should be appreciated that the connection between the rod and ram can be made detachable, as shown, so that other types of impact driven tool heads may be used in conjunction with the piston/cylinder assembly of the present invention. Examples of such alternative impact tool heads are shown in FIGS. 7 and 8, and will be explained, below.

The rod 4 slides within a shock absorber tube 14 which guides the linear motion of the rod as it slides through the cylindrical tube housing 6. The shock absorber tube 14 is supported within the tube by a pair of seal retainers. The piston seal retainer 15 is positioned within the tube relatively near the piston, while the ram seal retainer 16 is positioned near the ram 1. One purpose of the seal retainers is to support the shock absorber tube 14 for frictional sliding motion through central bores within the retainers. A second purpose of the retainers is to form a sealed housing within the tube 6 for a volume of oil 22 that resides between the retainers 15 and 16. The shock absorber includes an integral annular ring 23 which is positioned at a mid-point along the shock absorber tube 14. A small oil flow gap 24 exists between the annular ring and the inner surface of the tube 6, as best seen in FIG. 2. As will be explained more fully later, the annular ring 23 serves as a brake member for the ram 1.

The ram edge is formed of hardened steel to provide the strength needed for the impact of the ram against a closure. In prior art devices, the ram member is usually constructed as a very heavy and bulky member to generate the momentum necessary for opening a closure upon impact. In the present invention, the momentum is generated by an explosive actuator, so the bulkiness of the ram is not needed. The ram works by putting kinetic energy into the ram assembly. Kinetic energy is proportional to the square of the velocity of a moving object. A light object moving at high speed can store a tremendous amount of energy. The ram assembly of the present invention is designed to be light in relation to the rest of the device to avoid unacceptable recoil of the unit overall. Hence, the ram 1 is formed with indentations 25 as shown in FIG. 3, to bring down the total weight of the ram without sacrificing its overall strength. At one end of the ram is the impact edge 9 and at the opposite end of the ram is a detachable connection means 26 to allow the ram to be rigidly fastened to the end of the rod 4. It should be appreciated that there are many conventional fastening mechanisms that could be used to connect the ram to the rod; hence, details of the fastener 26 will not be further explained.

Referring back to FIG. 2, the tube connects to the chamber 8. The chamber includes a bore into which fits a shell 17. In the present invention depicted in FIGS. 1 and 2, the shell is a modified 12 gage shotgun shell that does not include the conventional shotgun pellets at the end of the shell. However, the shell does include the conventional primer and gun powder. It should be appreciated that other types of modified shells and corresponding chambers could be used with the present invention, as well.

There are many different ways that the primer of an explosive shell can be actuated. One way is illustrated in FIG. 2, which shows a diagrammatical representation of a standard firing mechanism having a conventional hammer 52, trigger 54, and firing pin 56 arrangement connected to the firing chamber 8. (The diagrammatical firing pin arrangement is not shown in the other figures). When the trigger 54 is depressed, a spring 58 causes the hammer 52 to strike the firing pin 56, which drives the firing pin into the primer area of the cartridge 17. As is readily appreciated by those skilled in the art, striking the primer of a cartridge, such as in a standard 12-gauge shotgun shell, causes an explosion within the cartridge. Thus, the conventional firing pin arrangement shown in FIG. 2, serves as a means for actuating an explosion. The firing mechanism could include a revolver, a semiautomatic firing system, or even a manually actuated trigger at the end of the chamber 8. Almost any type of firing mechanism could be used with the modification of removing the barrel of a weapon. In this case, the barrel of the weapon is represented by the hollow tube and the projectile is the piston. Once the primer of the explosive cartridge 17 actuates the gun powder within the shell, the resulting explosion forces the piston 7 forwardly within the tube 6 in a manner that is very similar to a bullet being forced by a blast through the barrel of a gun. It is the explosive actuation of the piston that enables the battery ram of the present invention to generate much more impact than any prior art device using manual force or compressed air to actuate the ram. Thus, the cartridge 17 acts as a means for producing an explosion to drive the piston 7 forwardly and power the ram.

Figure 4:
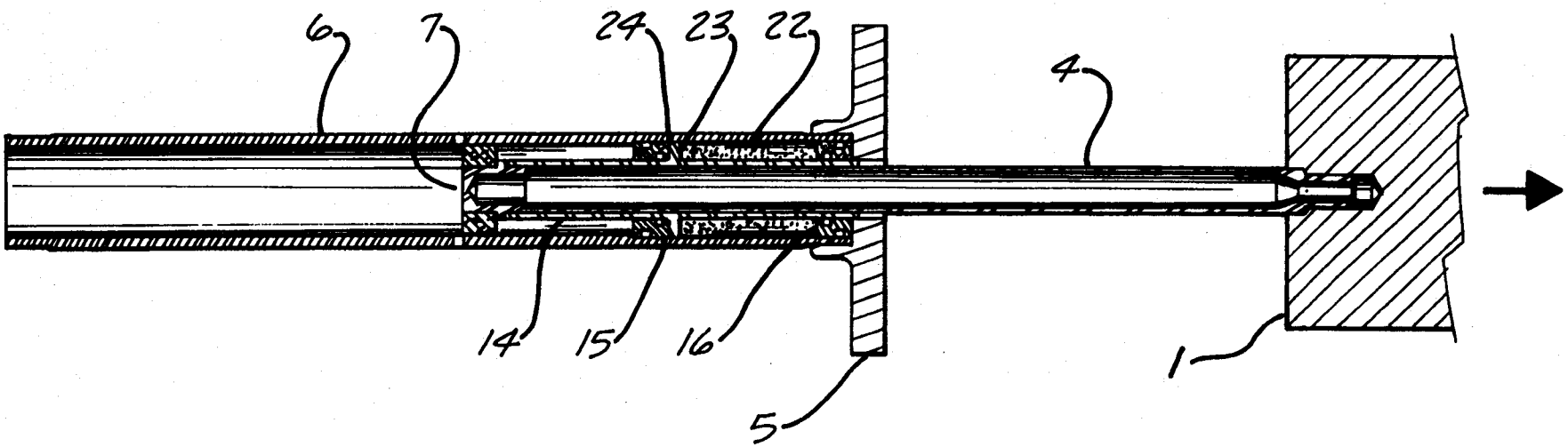
FIG. 4 shows a detailed cross-sectional view of the cylinder tube of the battering ram of FIG. 1 with the piston being driven forwardly against a shock absorber.
Figure 5:
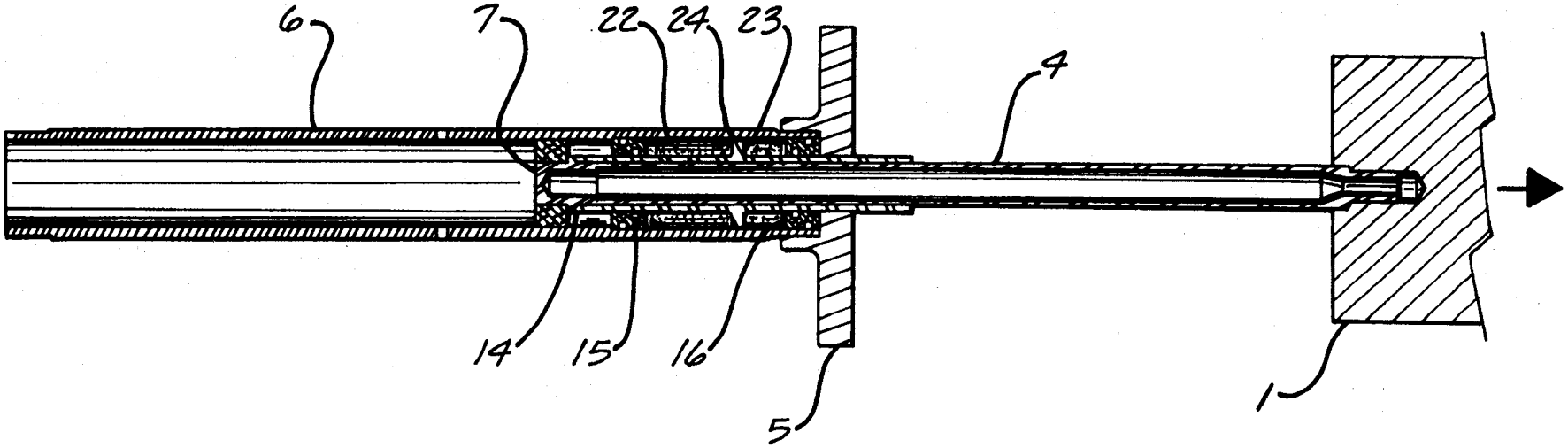
FIG. 5 shows a detailed cross-sectional view similar to FIG. 4 with the forward movement of the piston being retarded by the shock absorber.
Figure 6:
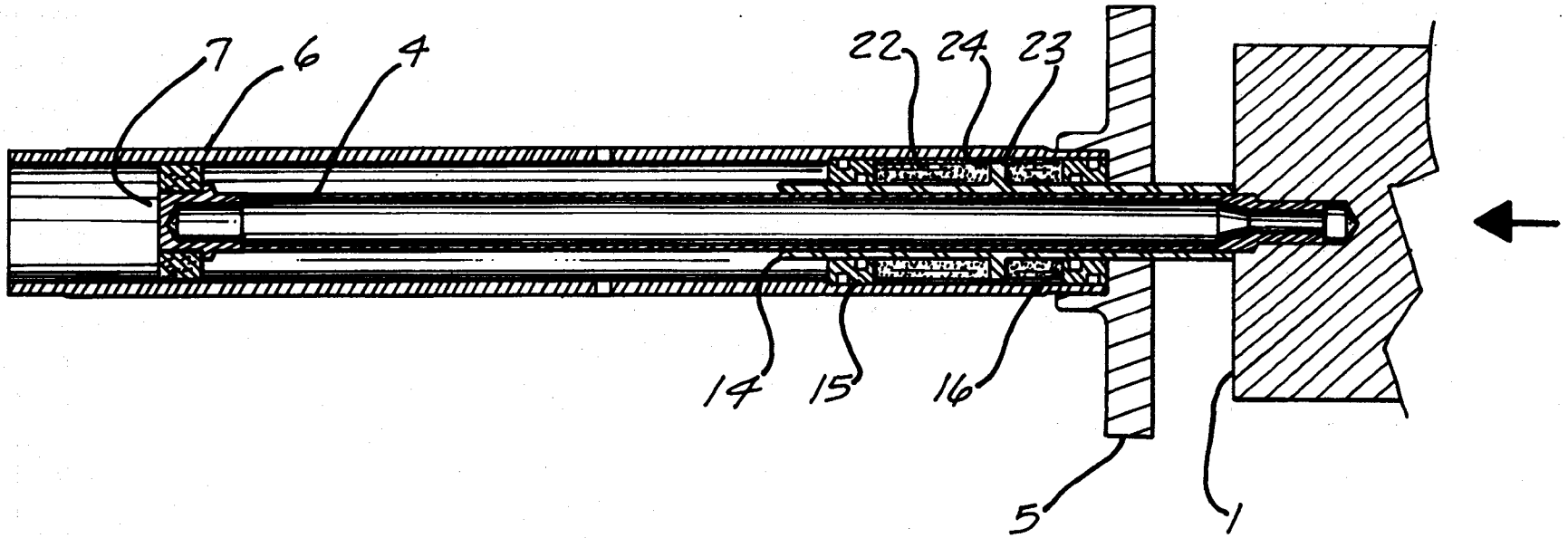
FIG. 6 shows a detailed cross-sectional view similar to FIG. 4 with the recoil movement of the piston being retarded by the shock absorber.

The operation of the shock absorber 14 in retarding the motion of the rod 4 can best be viewed within the sequential views of FIGS. 4–6. FIG. 4 shows the initial position of the shock absorber tube 14 where the annular ring 23 is positioned against the piston seal retainer 15. The entire volume of oil 22 is located on the opposite side of the annular ring (right side as viewed in FIGS. 4–6). The piston 7 is shown being driven forward by the explosive cartridge (not shown in FIGS. 4–6). At the point shown in FIG. 4, the piston has been drive far enough forward so that the ram edge has exited the ram housing and has begin its impact against a closure. Without some type of energy absorbing mechanism, the ram would continue on its motion and could cause united damage to anything beyond the door.

As shown in FIG. 2, the piston end of the shock absorber tube 14 projects from the annular ring 23 towards the piston 7. When the piston abuts against the piston end of the shock absorber tube 14, as shown in FIG. 5, the piston end of the shock absorber tube acts as a piston drive member to begin to drive the annular ring 23 through the oil 22. At this point, the oil 22 beings to retard the forward motion of the rod 4. The absorption of the energy is caused by the motion of the annular ring 23 moving through the oil 22. Oil is allowed to flow to the piston side (left side in FIGS. 4–6) of the ring through the oil flow gap 24 formed between the ring and the inner surface of the tube 6. The ram end of the shock absorber tube 14 continues forward in its motion. The central hole 21 within the end mounting plate accomodates this forward motion, and allows the ram end of the shock absorber to temporarily move into the ram housing. This type of arrangement can significantly absorb the energy imparted to the rod upon the explosive actuation of the piston. The explosion mechanism and the shock absorber assembly can be designed such that a no-load firing of the battery ram (where the ram does not abut against any surface) results in the entire amount of energy of the rod to be total absorbed by the motion of the ring moving through the oil 22. Thus, the ring 23 acts as a brake member. This prevents any significant impact of the ring against the ram seal retainer 16 that would cause damage to these parts.

FIG. 6 shows the third sequential view of the firing of the piston 7 through the tube 6. Once the energy of the rod has been fully absorbed, the ram can sometimes recoil upon impact and force the rod 4 in a backward motion through the tube 6. The shock absorber of the present invention also has utility in absorbing the energy imparted to the rod by a recoil of the ram 1. As shown in FIG. 5, the ram end of the shock absorber tube 14 projects from the annular ring 23 towards the ram 1. When the ram recoils, it impacts the ram end of the shock absorber tube 14 as shown in FIG. 6, driving the annular ring 23 to the left, or backwardly through the oil 22. Thus, the ram end of the shock absorber tube 14 acts as a recoil drive member. As the tube 14 moves, the oil 22 that had previously been displaced to the piston side of the ring 23 begins to flow to the ram side of the ring through the oil flow gap 24. The movement of the ring backwardly through the oil retards the motion of the rod 4, thereby absorbing the energy developed by the recoil of the ram. In the present invention, oil is used as the material used to retard the movement of the tube 14. Many other fluids could be used instead of oil including many different types of liquids an gases, or even air.

It should be appreciated that the recoil of the ram will not return the ram back to its fire-ready position. Many different return mechanisms could be used to force the ram 1 all the way back against the end mounting plate 5. In the embodiment shown, the ram edge 9 could be manually pressed back into its housing. However, a more automatic solution would be to provide a return spring between the piston 7 and seal retainer 15. An extra advantage of the energy absorption system of the present invention used in conjunction with a return spring is that the shock absorber tube 14 would additionally dissipate energy developed by the return spring. Thus, a strong return spring can be used without fear that the spring will return the ram too quickly, thereby causing damage to individual parts of the ram device.

FIG. 7 shows an attachment to the end of the piston/-cylinder mechanism of the present invention. In this case, the ram and ram housing is replaced with a cylindrical punch 31 and its correspondingly cylindrical housing 32. The punch housing has its own tube end fitting 33 that is attached to the tube 6 of the present invention in the same manner as the ram housing of FIGS. 1–6 is attached to the tube. The punch can be especially effective in knocking out the door locking mechanisms of metal doors by placing the punch between the door knob and the door jamb. The explosive actuation of the punch can subsequently break the door lock bolt upon impact against the door.

FIG. 8 shows another attachment to the end of the piston/cylinder mechanism of the present invention. In this case, the ram and housing is replaced with a bar cutter 41 and its correspondingly cylindrical housing 42. The housing 42 further includes a U-shaped bar holding portion 43 at the end, therefor, to hold a bar 50 against the cutting edge 44 of the bar cutter 41. The bar cutter has its own threaded end that is attached to the tube 6 of the present invention in the same manner as the ram housing of FIGS. 1–6 is attached to the tube. The bar cutter is specifically configured to cut heavy gaged bar and cable. The explosive actuation of the bar cutter severs the bar 50, depicted in FIG. 8.

It should be apparent that many modifications could be made to the battery ram which would still be encompassed within the spirit of the present invention. For example emergency limit stops may be provided on the ram head 1 to abut against corresponding limit stops within the ram housing to prevent the ram from ejecting from the housing in case of failure of the device. It is intended that all such modifications may fall within the scope of the appended claims.

What is claimed is:

1. An impact device for delivering a large impact force against an impact surface, comprising:

an impact delivery head having a first end with an impact edge for engaging against the impact surface;

an impact head housing for surrounding said impact head and guiding the motion of said head into and out of said impact head housing, said impact head housing having an open end for allowing said head to extend out of said impact head housing and subsequently impact against the impact surface;

a linking member having a first end rigidly attached to a second end of said impact head and a second end acting as a piston;

an elongated housing for guiding reciprocal movement of said linking member such that said impact head may move between a first position wherein said head is fully retracted into said impact head housing and a second position wherein said head extends out of said impact head housing;

a means for explosively moving said piston end of said linking member to correspondingly move said impact head at high velocity from said first position to said second position in order to deliver the large impact force; and a means for braking movement of said impact head once said impact head moves to said second position, the braking means including;

(a) a fluid chamber;

(b) fluid disposed in the fluid chamber; and (c) means associated with the linking member to move therewith for imposing a shearing force on the fluid in the chamber to generate a drag resistance force on the linking member.

2. An impact device as claimed in claim 1, wherein, said means for explosively moving said piston end of said linking member comprises:

a hollow chamber adjacent said piston end of said linking member when said impact head occupies said first position; and a cartridge which may be moved into and out of said chamber, said cartridge comprising a means for providing an explosion for driving said piston end of said linking member in a forward direction and means for actuating said explosion.

3. An impact device as claimed in claim 1, wherein, said impact head comprises an elongated ram member having a substantially thin rectangular cross section.

4. An impact device as claimed in claim 1, wherein, said impact head comprises a elongated punch having a substantially circular cross section.

5. An impact device as claimed in claim 1, wherein, said impact head comprises a cutting member having a cutting edge to provide a severing action against the impact surface.

6. An impact device for delivering a large impact force against an impact surface, comprising:

an impact delivery head having a first end with an impact edge for engaging against the impact surface;

an impact head housing for surrounding said impact head and guiding the motion of said head into and out of said impact head housing, said impact head housing having an open end for allowing said head to extend out of said impact head housing and subsequently impact against the impact surface;

a linking member having a first end rigidly attached to a second end of said impact head and a second end acting as a piston;

an elongated housing for guiding reciprocal movement of said linking member such that said impact head may move between a first position wherein said head is fully retracted into said impact head housing and a second position wherein said head extends out of said impact head housing;

a means for explosively moving said piston end of said linking member to allow said impact head to move from said first position to said second position;

wherein said explosive movement of said piston end of said linking member allows said impact head to move to said second position at a high velocity in order to deliver the large impact force against the impact surface; and a means for absorbing energy of said impact head during said explosive movement of said piston end of said linking member, once said impact head moves to said second position, said energy absorbing means including:

a tube for surrounding a portion of said linking member, said tube having an opening through which said linking member may move and a piston abutment surface for allowing said piston end of said linking member to abut against said tube;

a predetermined volume of fluid for retarding the motion of said tube and said linking member once said impact head moves to said second position.

7. An impact device as claimed in claim 6, wherein, said fluid comprises a liquid.

8. An impact device as claimed in claim 6, wherein said fluid comprises air.

9. An impact device as claimed in claim 6, wherein said fluid comprises a gas.

10. An impact device for delivering an impact force against a surface, the impact device comprising:

a cylinder;

a piston, having a piston head side and a link side, slidably disposed within the cylinder, the piston being movable from a first position within the cylinder to a second position within the cylinder;

an impact head connected to the link side of the piston;

a means for causing high speed movement of the piston from the first position within the cylinder, to the second position within the cylinder;

a means for absorbing energy of the piston during movement of the piston within the cylinder, the means for absorbing energy including:

(a) a means for confining a fluid;

(b) a fluid disposed in the means for confining a fluid; and (c) a means for forcing the fluid in the confining means through an aperture which is disposed in fluid flow communication with the confining means.

11. The impact device of claim 10, wherein the impact head comprises a cutting member having a cutting edge to provide a severing action against the surface.

12. An impact device for delivering an impact force against a surface, the impact device comprising:

a cylinder;

a piston, having a piston head side and a link side, slidably disposed within the cylinder, the piston being movable from a first position within the cylinder to second position within the cylinder;

an impact head connected to the link side of the piston;

a means for causing high speed movement of the piston from the first position within the cylinder, to the second position within the cylinder; and a means for absorbing energy of the piston, wherein the means for absorbing energy includes:

a fluid; and a brake member disposed within the fluid, wherein movement of the piston causes the brake member to move through the fluid.

13. The impact device of claim 12, wherein the means for absorbing energy further comprises a piston drive member projecting from the brake member towards the piston, whereby the piston impacts the piston drive member during movement of the piston from the first position to the second position, causing the brake member to be driven through the fluid.

14. The impact device of claim 12, wherein the piston is moveable from the second position to the first position and wherein the means for absorbing energy further comprises a recoil drive member projecting from the brake member towards the impact head, whereby the impact head impacts the recoil drive member during movement of the piston from the second position to the first position, causing the brake member to be driven through the fluid.

15. The impact device of claim 12, wherein the fluid comprises air.

16. The impact device of claim 12, wherein the means for explosively moving the piston comprises a firing chamber, the cylinder including an end disposed between the firing chamber and the piston head side of the piston.

17. An impact device for delivering an impact force against a surface, the impact device comprising:

a cylinder having first and second ends;

a piston, having a piston head side and a link side, slidably disposed within the cylinder, the piston being movable from a first position within the cylinder to a second position within the cylinder;

an impact head connected to the link side of the piston;

a means for causing high speed movement of the piston from the first position within the cylinder, to the second position within the cylinder, including a first chamber connected to one end of the cylinder, wherein the piston head side of the piston faces towards the firing chamber, the firing chamber having a diameter sized to slidably receive a standard shotgun shell; and braking means for braking the piston during movement of the piston within the cylinder, the braking means including:

(a) a chamber;

(b) a fluid disposed within the chamber; and (c) a means associated with the movement of the piston to move therewith to impose a compression force on the fluid within the chamber.

18. The impact device of claim 17, wherein the firing chamber has a diameter sized to slidably receive a standard twelve gauge shotgun shell.

19. The impact device of claim 17, wherein the fluid comprises a gas.

20. The impact device of claim 17, wherein the braking means further includes a brake member disposed within the fluid, wherein movement of the piston causes the brake member to move through the fluid.

* * * * *

UNITED STATES PATENT AND TRADEMARK OFFICE

CERTIFICATE OF CORRECTION

PATENT NO. : 5,415,241

DATED : May 16, 1995

INVENTOR(S) : M.S. Ruffu et al.

It is certified that error appears in the above-indentified patent and that said Letters Patent is hereby corrected as shown below:

| COLUMN | LINE | |
|---|---|---|
| [73] (pg. 1, col. 1) | Assignee | "TAC Inc.," should read --TAC INC,-- |
| 4 | 65 | "drive" should read --driven-- |
| 4 | 67 | "begin" should read --begun-- |
| 5 | 2 | "united" should read --unintended-- |
| 5 | 26 | "total" should read --totally-- |
| 5 | 40 | "ram recoils," should read --ram 1 recoils,-- |
| 6 | 21 | "therefor," should read --thereof,-- |

UNITED STATES PATENT AND TRADEMARK OFFICE

CERTIFICATE OF CORRECTION

PATENT NO. : 5,415,241

DATED : May 16, 1995

INVENTOR(S) : M.S. Ruffu et al.

It is certified that error appears in the above-indentified patent and that said Letters Patent is hereby corrected as shown below:

| | | |
|---|---|---|
| 8 (Claim 12, | 39 line 7) | "to second" should read --to a second-- |
| 9 (Claim 17, | 19 line 13) | "first" should read --firing-- |

Signed and Sealed this

Third Day of October, 1995

Bruce Lehman

*Attest:*

BRUCE LEHMAN

*Attesting Officer*

*Commissioner of Patents and Trademarks*